US007506948B2

(12) United States Patent
Nonaka

(10) Patent No.: US 7,506,948 B2
(45) Date of Patent: Mar. 24, 2009

(54) IMAGE FORMATION APPARATUS

(75) Inventor: Manabu Nonaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 436 days.

(21) Appl. No.: 11/201,735

(22) Filed: Aug. 11, 2005

(65) Prior Publication Data

US 2006/0038870 A1 Feb. 23, 2006

(30) Foreign Application Priority Data

Aug. 18, 2004 (JP) ..... 2004-237893

(51) Int. Cl.
*B41J 2/01* (2006.01)

(52) U.S. Cl. ..... 347/14; 347/101; 347/104

(58) Field of Classification Search ..... 347/104, 347/101, 103, 14, 19, 15
See application file for complete search history.

(56) References Cited

U.S. PATENT DOCUMENTS 5,816,723 A * 10/1998 Takahashi et al. ..... 400/624
6,024,428 A * 2/2000 Uchikata ..... 347/7
6,117,240 A * 9/2000 Tomono et al. ..... 118/668
6,246,860 B1 * 6/2001 Ohmichi ..... 399/406
6,416,176 B1 * 7/2002 Yasui et al. ..... 347/104
2001/0030670 A1 * 10/2001 Kikuchi et al. ..... 347/15
2003/0160838 A1 * 8/2003 Su et al. ..... 347/19
2003/0189629 A1 * 10/2003 Tsuji et al. ..... 347/104
2003/0210293 A1 * 11/2003 Tsutsui et al. ..... 347/16
2005/0104927 A1 5/2005 Kudoh et al.

FOREIGN PATENT DOCUMENTS

JP 04-255354 9/1992
JP 2000-1010 1/2000
JP 2001-139849 5/2001

* cited by examiner

*Primary Examiner*—Manish S Shah
(74) *Attorney, Agent, or Firm*—Cooper & Dunham, LLP

(57) ABSTRACT

An image formation apparatus for forming an image on a recording medium to be recorded, having a recording head for discharging a liquid drop of recording liquid, which apparatus includes a part configured to perform a paper ejecting operation after standby until curl of the recording medium to be recorded becomes difficult to occur, on a condition of binding a top and bottom of at least one portion of the recording medium to be recorded on which image formation using the recording head has been completed.

11 Claims, 6 Drawing Sheets

IMAGE FORMATION APPARATUS

BACKGROUND

1. Technical Field

The present disclosure relates to an image formation apparatus.

2. Description of the Related Art

As an image formation apparatus such as a printer, a facsimile machine, a copying machine, a printer/fax/copier composite machine, an ink jet recording apparatus is known for performing image formation (recording, printing, and imaging are used as the same meaning.) by making a liquid drop of recording liquid (also referred to as an ink drop, below) adhere to a paper using a recording head (image formation part) composed of a liquid discharging head for discharging the liquid drop of recording liquid, while a recording medium to be recorded (a paper, a recording medium, a transcribing medium, etc., are used as the same meaning.) is carried.

Thus, in the ink jet recording apparatus, since an image is formed using recording liquid and a certain amount of time is required until the recording liquid applied on a recording medium to be recorded is dried, while the recording liquid applied on the recording medium to be recorded is dried, the recording medium to be recorded on which the image formation has been completed is made be on standby inside the apparatus or, when double-sided printing is performed, after the recording medium to be recorded is once ejected onto an ejected paper tray, paper refeeding is performed.

For example, there is a description of having a part for delaying the ejection of a current recording paper onto an ejected paper tray by a set time when the result of judgment for a previous dot density is over a predetermined set value, in Japanese Patent No. 3109529.

Also, when double-sided printing is performed, after imaging is performed on one side of a paper, at least one portion of the paper is once ejected out of an apparatus body so that drying time can be kept, in Japanese Laid-Open Patent Application No. 2000-001010.

Meanwhile, recording liquid with a high viscosity (highly viscous ink) tends to be used in an ink jet apparatus in order to realize high speed and high quality image recording to a normal paper. That is, in ink jet recording, particularly when printing is applied on a normal paper, an image quality degradation problem that is specific to ink jet recording, on color reproducibility, durability, light resistance, ink drying property, character running (feathering), color border bleeding (color bleed), etc., of an image, is made be apparent, and when high speed printing is performed on a normal paper, it has been a very difficult problem to perform printing while all of these characteristics are satisfied.

Also, recording liquid (ink) used for ink jet recording is commonly based on water and generally contains a wetting agent such as glycerin for the purpose of the prevention of clogging, etc. As a coloring agent, there are provided a dye and a pigment, but, conventionally, dye-containing ink has been frequently employed in a color part since excellent chromophoric property or stability can be obtained. However, the fastness properties, such as light resistance and water resistance, of an image obtained using the dye-containing ink is inferior to the case of using a pigment as a coloring agent, and particularly, with respect to the water resistance, if a recording paper for the exclusive use of ink jet which has an ink absorbing layer is used, a certain degree of improvement can be provided, but if a normal paper is used, satisfaction has not been obtained.

Consequently, the use of pigment-containing ink in which an organic pigment, carbon black, etc., is used as a coloring agent has been investigated or the ink has been put to practical use, for printing on a normal paper, in order to solve the problem on the dye-containing ink in the case of using the normal paper. Since a pigment does not have solubility to water differently from a dye, a pigment is commonly mixed with a dispersing agent so as to be used as water-based ink on the condition that the pigment is stably dispersed by the dispersion treatment.

Since such pigment-based ink is generally highly viscous ink (5 mPa s or greater), the ink has a quick-drying property compared to the dye-containing ink in the case of printing on a normal paper, but there is a problem that curl of a recording medium to be recorded easily occurs.

That is, since free water of the dye-containing ink penetrates to the back face of a recording medium to be recorded so that the difference between water contents on the front and back faces of the recording medium to be recorded is reduced, the curl originating from the difference between the water contents on the front and back faces of the recording medium to be recorded is relatively difficult to occur although it takes a long time to dry.

On the other hand, since the pigment-based ink has a quick-drying property, it does not take so much time for the ink to dry on a recording medium to be recorded, and, however, since it takes a long time to penetrate into the recording medium to be recorded and the difference between water contents on the front and back faces of the recording medium to be recorded becomes large, the curl originating from the difference between the water contents on the front and back faces of the recording medium to be recorded easily occurs, and when the curl occurs, the ink solidifies on the condition of leaving the curl due to the quick-drying property.

Thus, when a paper on which the curl occurs is carried as it stands, there is a problem that a jam occurs, or the stability of paper ejection deteriorates so that folding, etc., occurs and the quality of a print degrades.

BRIEF SUMMARY

In an aspect of the present disclosure, an image formation apparatus is provided in which curl decreases even though printing on a normal paper is performed using highly viscous recording liquid.

In an exemplary embodiment of the present disclosure, an image formation apparatus for forming an image on a recording medium to be recorded, having a recording head for discharging a liquid drop of recording liquid, is provided which apparatus includes a part configured to perform a paper ejecting operation after standby until curl of the recording medium to be recorded becomes difficult to occur, on a condition of binding a top and bottom of at least one portion of the recording medium to be recorded on which image formation using the recording head has been completed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
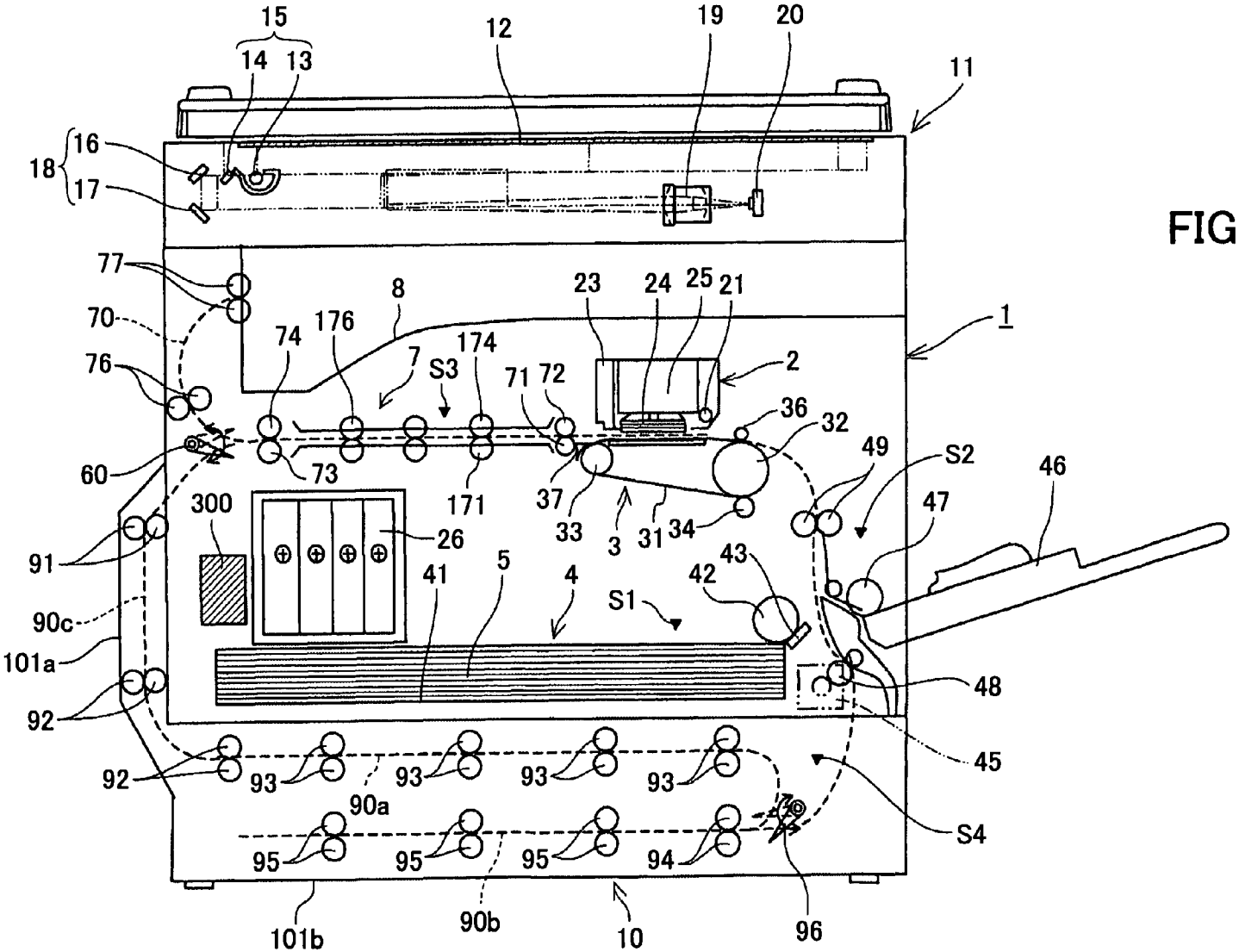
FIG. 1 is a schematic diagram showing the entire structure of an image formation apparatus according to the present invention.

An image formation apparatus of one embodiment of the present invention is configured to have a part for performing a paper ejecting operation after standby until curl of the recording medium to be recorded becomes difficult to occur, on a condition of binding a top and bottom of at least one portion of the recording medium to be recorded on which image formation by the recording head has been completed. Herein, "top and bottom" means "both faces of a recording medium to be recorded".

On the above, it is preferable to bind a top and bottom of at least one portion of the recording medium to be recorded by a roller and a spur on a condition of holding the lower side of the recording medium to be recorded with a guide plate.

Also, it is preferable that a time period for standby until curl of the recording medium to be recorded becomes difficult to occur is variably set based on a detection result of absolute humidity. In this case, it is preferable to detect ambient temperature and humidity around a paper feeding cassette to be loaded with the recording medium to be recorded and to detect absolute humidity based on these detection results, or to detect ambient temperature and humidity around a recording medium to be recorded on which image formation by the recording head has been completed and to detect the absolute humidity based on these detection results.

Further, it is preferable to stop the recording medium to be recorded and to make the recording medium to be recorded be on standby, and in this case, it is preferable to make the recording medium to be recorded be on standby on the condition that a rear end portion of the recording medium to be recorded is located within a scanning area for the recording head, and further, it is preferable to save the recording head from a printing or imaging area.

Also, it is possible that the recording medium to be recorded is carried inside the apparatus while the binding state is maintained, and the recording medium to be recorded is made be on standby. Further, it is also possible to make the recording medium to be recorded be on standby based on a quantity of liquid drop applied to the recording medium to be recorded.

Moreover, it is preferable that a driving part for sending the recording medium to be recorded to a location for image formation by the recording head is different from a driving part for ejecting the recording medium to be recorded. Also, it is preferable to form an image using a recording liquid with a viscosity equal to or greater than 5 mPa s at 25° C.

Since an image formation apparatus of the aforementioned embodiment of the present invention has a part for performing a paper ejecting operation after standby until curl of the recording medium to be recorded becomes difficult to occur, on a condition of binding a top and bottom of at least one portion of the recording medium to be recorded on which image formation by the recording head has been completed, curl can be possibly suppressed so as to reduce the curl even though printing on a normal paper is performed.

Figure 2:
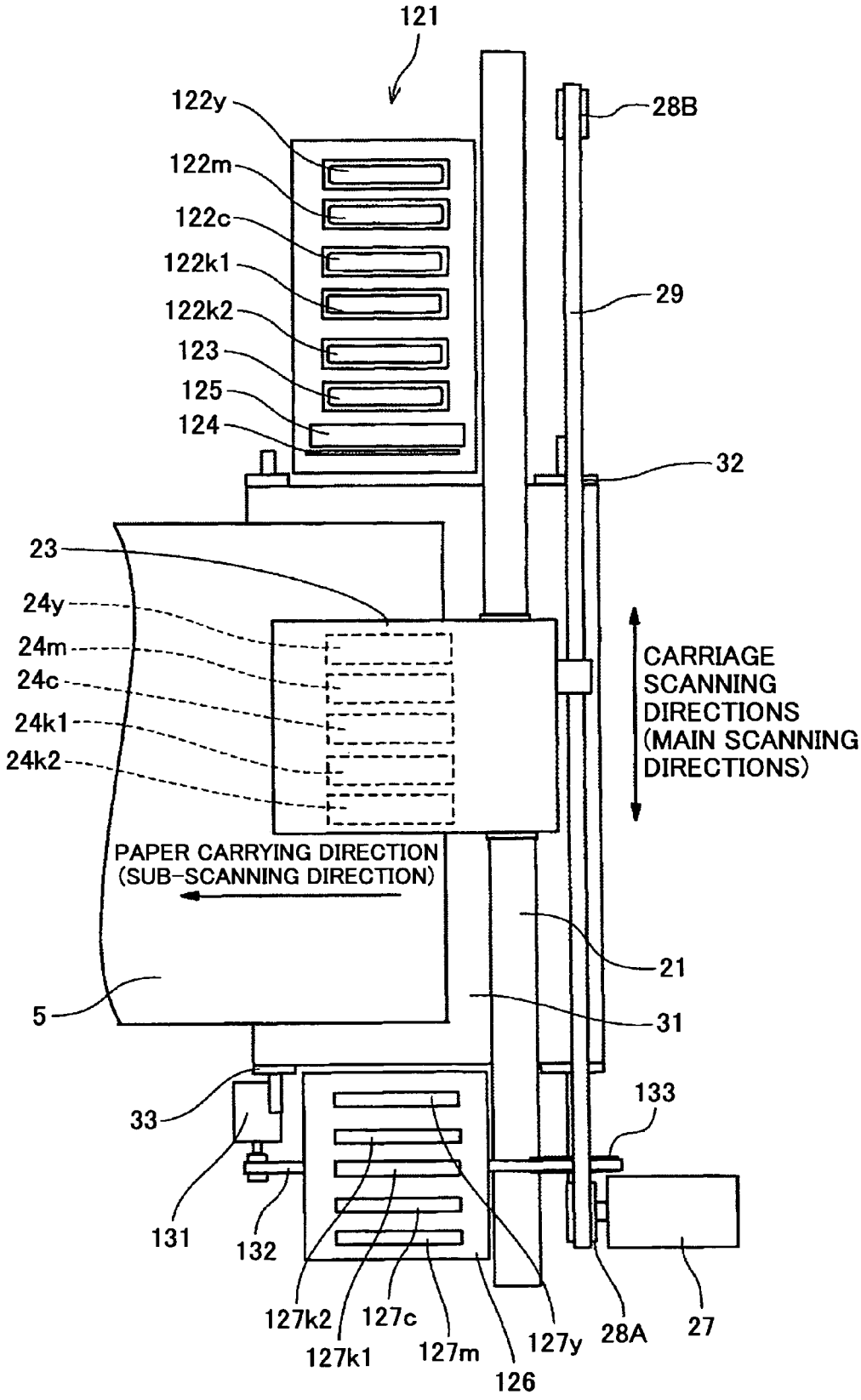
FIG. 2 is a plan view illustrating an image formation part and a sub-scan carrying part of the image formation apparatus.
Figure 3:
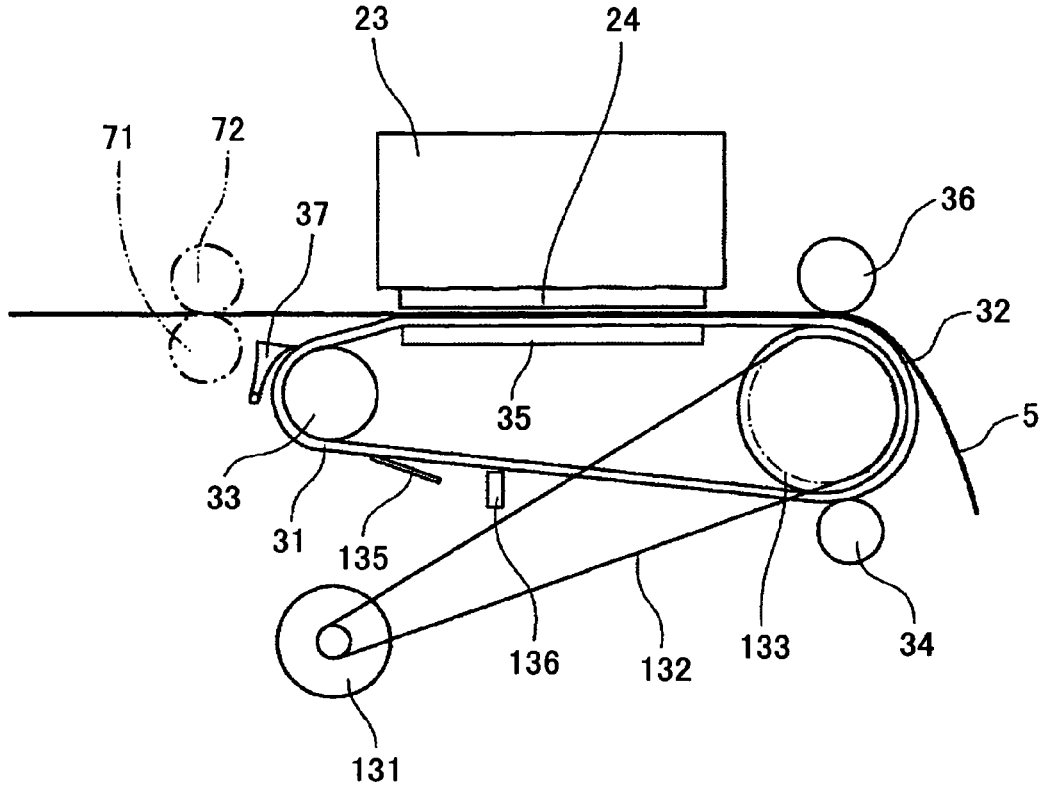
FIG. 3 is a side view illustrating an image formation part and a sub-scan carrying part of the image formation apparatus.
Figure 4:
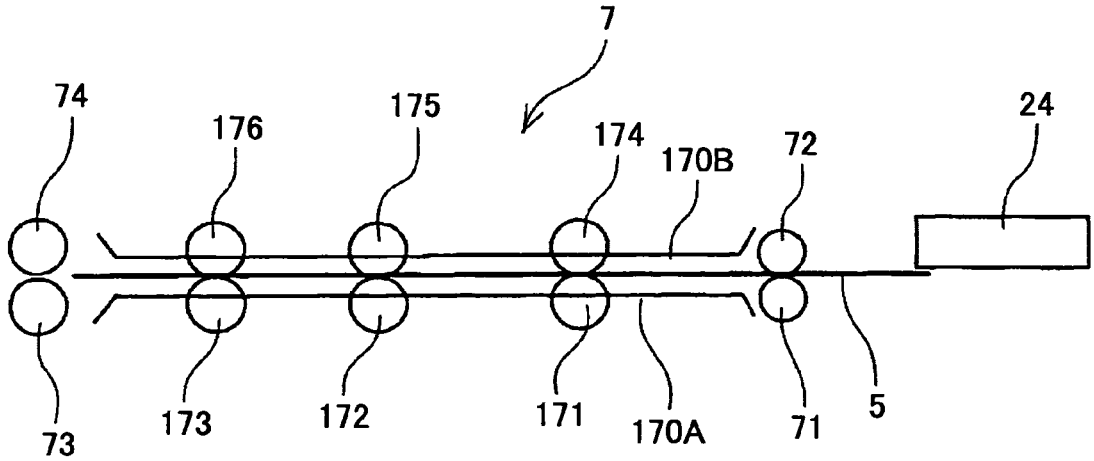
FIG. 4 is a diagram illustrating an essential part of a paper carrying and ejecting part of the image formation apparatus.

Next, the aforementioned embodiment of the present invention is explained below, with reference to attached drawings. Particularly, one example of an image formation apparatus according to the present invention is explained with reference to FIGS. 1 through 7. Herein, FIG. 1 is a schematic diagram showing the entire structure of the image formation apparatus, FIG. 2 is a plan view illustrating an image formation part and a sub-scan carrying part of the apparatus, FIG. 3 is a side view illustrating the parts, and FIG. 4 is a diagram illustrating an essential part of a paper carrying and ejecting part 7 of the apparatus.

This image formation apparatus has an image formation part 2, a sub-scan carrying part 3, etc., inside a apparatus body 1 (inside a housing), and after a drop of liquid is discharged from the image formation part 2 onto a paper 5 so as to form (record) a desired image while the paper 5 is fed one by one from a paper feeding part 4 provided on the bottom of the apparatus body 1 and the paper 5 is carried by the sub-scan carrying part 3 at a location opposing to the image formation part 2, in the case of one face printing, the paper 5 is ejected through an ejected paper carrying part 7 onto an ejected paper tray 8 formed on the top surface of the apparatus body 1, or, in the case of double-sided printing, the paper is sent to a double face unit 10 provided on the bottom of the apparatus body 1 in the middle of the ejected paper carrying part 7 so as to perform switch-back carry, paper feeding is done to the sub-scan carrying part 3 again, thereby resulting in the formation of images on both faces, and, subsequently, paper ejection is made on the ejected paper tray 8.

Also, this image formation apparatus includes an image reading part (scanner part) 11 for reading an image on the top of the apparatus body 1 and above the ejected paper tray 8 as an input system for image data (print data) formed on an image formation part 2. In this image reading part 11, an optical scanning system 15 including an illumination light source 13 and a mirror 14 and an optical scanning system 18 including mirrors 16, 17 move so as to read an image of a manuscript placed on a contact glass 12, and then, a scanned manuscript image is read as an image signal by an image reading element 20 arranged behind a lens 19, the read image signal is digitized, subjected to image processing, and image-processed print data can be printed.

Further, in this image formation apparatus, print data including image data, etc., from a host such as an information processing device such as an external personal computer, an image reading device such as an image scanner, and an imaging device such as a digital camera, as an input system for image data (print data) formed on an image formation part 2, is receivable via a cable or a network and received print data can be processed and printed.

Herein, as shown in FIG. 2, the image formation part 2 of this image formation apparatus holds a carriage 23 which is movable along main scanning directions by a guide lock 21 and a guide stay that is not shown in the figures and is moved for scanning by a main scanning motor 27 along the main scanning directions with a timing belt 29 engaging on a driving pulley 28A and an idler pulley 28B.

Then, a recording head 24 composed of liquid drop discharging heads for discharging a liquid drop of respective colors is mounted on this carriage 23, and is made be a shuttle type such that a liquid drop is discharged from the recording head 24 so as to perform image formation while the carriage 23 is moved along the main scanning directions and the paper 5 is sent by the sub-scan carrying part 3 along paper carrying directions (sub-scanning directions). Additionally, a line-type head can be also used.

The recording head 24 is composed of totally five liquid drop discharging heads, (referred to as "recording head 24" below, when the color thereof is not distinguished) which are two liquid drop discharging heads 24*k*1, 24*k*2 for discharging black (Bk) inks, respectively, and three liquid drop discharging heads 24*c*, 24*m*, 24*y* for discharging cyan (C) ink, magenta (M) ink, and yellow (Y) ink, respectively, and each color ink is supplied from each sub-tank 25 mounted on the carriage 23.

On the other hand, respective color ink cartridges 26 can be attached which are recording liquid cartridges containing black (Bk) ink, cyan (C) ink, magenta (M) ink, and yellow (Y) ink, respectively, such that the cartridge can be attached or detached at will, as shown in FIG. 1, and ink is supplied from each color ink cartridge 26 to each color sub-tank 25. Additionally, a configuration is taken such that black ink is supplied from one ink cartridge 26 to two sub-tanks 25.

Additionally, as a recording head 24, a piezo-type recording head which discharges a ink drop by changing a volume of an ink flow channel (pressure generation chamber) by deforming a oscillating plate for forming a wall surface of the ink flow channel using a piezoelectric element as a pressure generation part (actuator part) for pressurizing ink in the ink flow channel, a so-called thermal type recording head which discharges an ink drop with a pressure caused by generating air bubble by heating ink in an ink flow channel using an exothermic resistor, an electrostatic type recording head in which a oscillating plate for forming a wall surface of an ink flow channel and electrodes are oppositely arranged and which discharges an ink drop by changing a volume of an ink flow channel by deforming the oscillating plate due to an electrostatic force generating between the oscillating plate and the electrode, etc., can be used.

Also, a maintenance and recovery device 121 for maintaining and recovering the condition of a nozzle of the recording head 24 is arranged in a non-printing area at one side of scanning directions for the carriage 23 as shown in FIG. 2. This maintenance and recovery device 121 includes five caps for moisture retention 122*k*2, 122*k*1, 122*c*, 122*m*, 122*y* (referred to as a "cap for moisture retention 122" when the color thereof is not distinguished) for capping a nozzle surface of each head of the five recording heads 24, one cap for aspiration 123, a wiper blade 124 for wiping the nozzle surface of the recording head 24, a blank discharge receiving member 125 for performing the discharge (blank discharge) of a liquid drop that does not contribute to recording (image formation), etc.

Furthermore, a blank discharge receiving member 126 for performing the discharge (blank discharge) of a liquid drop that does not contribute to recording (image formation) from the five recording heads 24 is included in a non-printing area at the other side of scanning directions for the carriage 23 as shown in FIG. 2. On this blank discharge receiving member 126, five apertures 127*k*2, 127*k*1, 127*c*, 127*m*, 127*y* (referred to as an "aperture 127" when the color thereof is not distinguished) are formed which correspond to recording heads 24.

Also, as shown in FIG. 3, the sub-scan carrying part 3 includes a no-end-type carrying belt 31 engaging on a carrying roller 32 being a driving roller and a idler roller 33 being a tension roller, for changing a carrying direction of the paper 5 fed from underneath by an angle of approximately 90 degree so as to oppose to the image formation part 2 for carrying the paper, a charging roller 34 being a charging part for which a high voltage being an alternating potential difference is applied from a high-voltage power supply for charging a surface of this carrying belt 31, a guide member 35 for guiding the carrying belt 31 in an area opposing to the image formation part 2, a pressure control roller (pressurizing control roller) 36 for pressing the paper 5 to the carrying belt 31 at a location opposing to the carrying roller 32, and a separation claw 37 for separating from the carrying belt 31 the paper 5 on which an image is formed by the image formation part 2.

The carrying belt 31 of this sub-scan carrying part 3 is configured such that the belt revolves to the paper carrying direction (sub-scanning direction) of FIG. 2 by rotating the carrying roller 32 due to a sub-scanning motor 131 and using a timing belt 132 and a timing roller 133. Additionally, the carrying belt 31 has a bi-layer structure of a front layer having a paper adsorption surface formed of, for example, a pure resin material for which resistance control has not been carried out, example, an ETFE pure material, and a back layer (middle resistance layer, earth layer) which is made of the same material as the material of this front layer and for which resistance control has been carried out with carbon, but is not limited to this structure and may be a single-layer structure or three or more-layer structure.

Also, a cleaning part 135 (wherein mylar is used) for removing powdery paper, etc, adhering to a surface of the carrying belt 31 and a charge eliminating brush 136 for eliminating a charge on a surface of the carrying belt 31 are included between the idler roller 33 and the charging roller 34.

A paper feeding part 4 includes a paper feeding cassette 41 attachable and detachable from the front side of the apparatus body 1 which cassette is loaded with and contains a number of the papers 5, and a paper feeding control roller 42 and friction pad 43 for separately sending the papers 5 inside the paper feeding cassette 41 one by one.

Also, this paper feeding part 4 includes a manual tray 46 loaded with and containing the papers 5, a manual control roller 47 for feeding the papers 5 from the manual tray 46 one by one, a carrying control roller 48 for carrying the papers 5 fed from the paper feeding cassette 41 or the double face unit 10 which is optionally attached on the bottom of the apparatus body 1, and a carrying control roller 49 for sending the fed papers 5 to the sub-scan carrying part 3. A member for sending the paper 5 to the sub-scan carrying part 3, such as the paper feeding control roller 42, is rotationally driven by a paper feeding motor (driving part) 45 composed of a HB-type stepping motor using a paper feeding clutch that is not shown in the figures.

Also, as shown in FIG. 4, the ejected paper carrying part 7 includes a carrying roller 71 and a spur 72 opposing to it, for sending the paper 5 separated by the separation claw 37 of the sub-scan carrying part 3, a guide plate 170A for guiding the paper 5 and supporting the lower side of the paper 5, an upper guide plate 170B opposing to this guide plate 170A, carrying rollers 73, 74 for carrying the paper 5, carrying rollers 171-173 and spurs 174-176 opposing to these rollers, for carrying the paper 5 and binding the top and bottom of the paper 5, a carrying roller pair 76 for sending the paper 5 to the ejected paper tray 8, and a paper ejection roller pair 77. A carrying path for ejecting the paper 5 onto this paper ejection tray 8 is referred to as an ejected paper carrying path 70.

The double face unit 10 integrally has a vertically carrying part 101*a* providing a vertical double face carrying path 90*c* on which the paper 5 guided by a bifurcation plate 60 is received from the side of the apparatus body 1 and is carried downward, and a horizontally carrying part 101*b* providing a horizontally incorporating and carrying path 90*a* for carrying the paper in a horizontal direction following the vertical double face carrying path 90*c* and a switch back carrying path 90*b*.

A double face entrance roller pair 91 for carrying the sent paper 5 downward and a carrying roller pair 92 for sending the paper to the horizontally incorporating and carrying path 90*a* are provided on the vertical double face carrying path 90*c*, five double face carrying roller pairs 93 are provided on the horizontally incorporating and carrying path 90*a*, and double face exit rollers 94 and three double face carrying roller pairs 95, composed of reverse rollers for reversing and refeeding the paper 5 sent from the incorporating and carrying path 90*a* are provided on the switch back carrying path 90*b*.

Also, a bifurcation plate 96 for switching a carrying path for the paper 5 from the incorporating and carrying path 90*a* to the switch back carrying path 90*b* and a carrying path for refeeding the paper from the switch back carrying path 90*b* to the carrying roller pair 48 is provided swingably. The bifurcation plate 96 is swingable between a position at the side of the switch back indicated by solid lines in FIG. 1 and a position at the side of paper refeeding indicated by broken lines in the figure.

Additionally, the bifurcation plate 60 is swingable between a position at the side of paper ejection indicated by solid lines in FIG. 1 and a position at the double face side of indicated by broken lines in the figure in order to switch the carrying direction of the paper 5 between the direction toward the ejected paper tray 8 and the side of the double face carrying unit 10 on the downstream side of the ejected paper carrying roller pair 75, when the plate is the position at the side of paper ejection, the paper 5 is guided to the side of the paper ejection roller pair 76, and when the plate is the position at the double face side, the paper 5 is guided to the side of the double face entrance roller pair 91.

Also, an imaging-starting sensor for detecting the front end of the paper 5 is provided on the upstream side of the image formation part 2 in the paper carrying direction, and, similarly, an imaging-terminating sensor for detecting the rear end of the paper 5 on the downstream side in the paper carrying direction, although the sensors are not shown in the figures.

Figure 5:
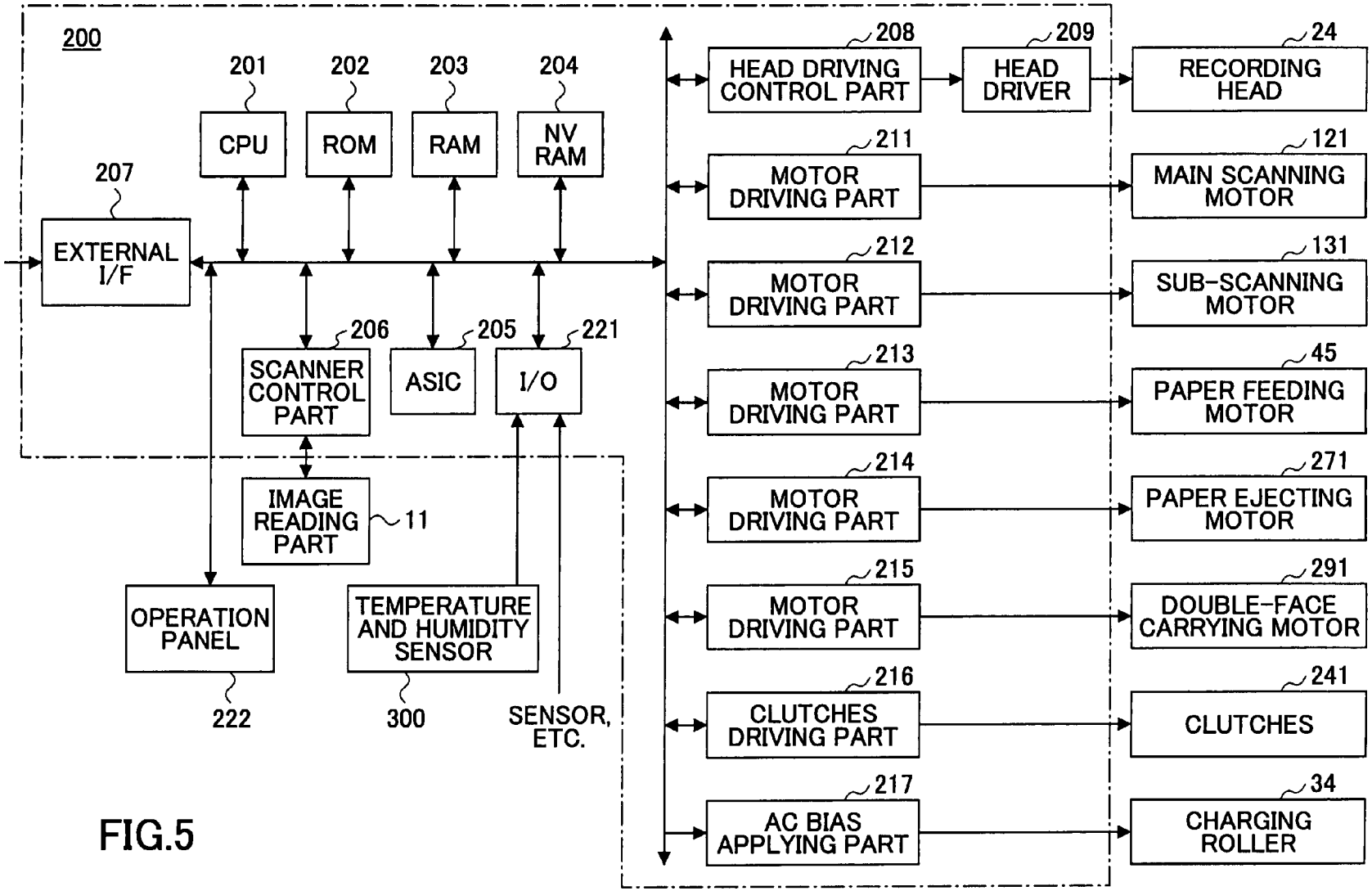
FIG. 5 is a block diagram provided for illustrating a control part of the image formation apparatus.

Next, the essence of a control part of this image formation apparatus is explained with reference to FIG. 5. Herein, the figure is a schematic block illustration of the control part.

This control part 200 includes a CPU 201 for conducting the control of the whole of this image formation apparatus, a ROM 202 for storing a program running on the CPU 201 and other fixed data, a RAM 203 for temporally storing image data (print data), etc., a non-volatile memory (NVRAM) 204 for keeping data even when a power supply of the apparatus turns off, an ASIC 205 for each kind of signal processing for image data, image processing for performing sorting, etc., and, otherwise, processing of an input or output signal for controlling the whole of the apparatus, and a scanner control part 206 for performing image reading using the image reading part 11, data processing for the read image, etc.

Also, this control part 200 includes an I/F 207 for transmitting and receiving data or a signal used for the case of receiving data from an external apparatus, a head driving control part 208 and a head driver 209, for driving and controlling the recording head 21 of the image formation part 2, a main-scanning motor 121 for conducting main-scanning of the carriage 23, a sub-scanning motor 131 for revolving the carrying belt 31 in one direction by rotating the carrying roller 32, a paper feeding motor 45, a paper ejecting motor 271 for rotationally driving rollers of the ejected paper carrying part 7, and motor driving parts 211-215 including a motor driver for each independently driving each kind of motor (driving source) such as a double face carrying motor 291 for rotationally driving rollers of the double face unit 10.

Also, a clutches driving part 216 for driving a paper feeding electromagnetic clutch for rotationally driving a paper feeding control roller 43, a bifurcation plate solenoid for swinging and displacing the bifurcation plate 60 between the position of paper ejection and the position of the double faces, a bifurcation plate solenoid for swinging and displacing the bifurcation plate 96 between the position of switch back and the position of paper refeeding, etc., (theses are referred to as "clutches 241"), an AC bias applying part 217 for applying an AC bias voltage (high voltage) to the charging roller 34, etc., are included.

Further, this control part 200 includes an I/O 221 for obtaining a detected signal from a temperature and humidity sensor 300 for detecting temperature and humidity and a detected signal from each kind of sensor such as the imaging-starting sensor and the imaging-terminating sensor that are not shown in figures, and an operation panel 222 for inputting and displaying information necessary for this apparatus is connected.

Herein, the temperature and humidity sensor 300 for detecting temperature and humidity is provided, at least, on any of locations denoted by sensors S1 through S4 of FIG. 1. Absolute humidity of surrounding in which the fed paper 5 is provided can be detected and the content of water contained in the fed paper 5 can be obtained by providing the temperature and humidity sensor 300 in the proximity of the paper feeding cassette 41 (at the location of sensor S1) loaded with the paper 5 being a recording medium to be recorded, whereby higher-precision curl prevention control can be provided.

Also, Absolute humidity of surrounding in which the paper 5 after the completion of image formation is provided can be detected and the drying condition of the paper 5 after the completion of image formation can be obtained by providing the temperature and humidity sensor 300 in the proximity of the paper 5 being a recording medium to be recorded on which image formation using the recording head 24 has been completed (at the location of sensor S3 of the ejected paper carrying part 7), whereby higher-precision curl prevention control can be provided.

Further, the temperature and humidity sensor 300 can be provided at a location at which the temperature and humidity of surrounding of the paper 5 fed from the paper feeding cassette 41, etc., (the location of sensor S2), at a location at which the temperature and humidity of the paper 5 to be refed can be detected (the location of sensor S4) in the case of double face printing, etc.

This control part 200 processes a read image and stores the image in a buffer inside the scanner control part 206 when a manuscript image is read by the image reading part 11. Also, when print data, etc., are received from the side of an external host such as an information processing device such as a personal computer, an image reading device such as an image scanner, an imaging device such as a digital camera, through the external I/F 207, the data, etc., are stored within a signal receiving buffer included in the I/F 207.

Then, the CPU 201 reads out and analyzes image data from the scanner control part 206 and the I/F 207, necessary image processing, the sort processing of data, etc., are carried out in the ASIC 205, and print image data are transferred to the head driving control part 208. Additionally, the creation of dot pattern data for the output of an image based on external data may be carried out, for example, by storing font data in the ROM 202 or may be done such that image data is developed to bit-map data in a printer driver on the side of an external host so as to be transferred to this image formation apparatus.

When the head driving control part 208 receives image data (dot pattern data) corresponding to one line for each recording head 24, these dot pattern data for one line are transferred to the head driver 209 and then the head driver 209 selectively applies a desired driving waveform to the actuator part of the recording head 24 based on the dot pattern data and drives the actuator such that a liquid drop is discharged from a desired nozzle of each recording head 24.

In such configured image formation apparatus, the paper 5 is fed one by one from the paper feeding part 4 or the double face unit 10 and pressurized to the carrying belt 31 by the pressure control roller 36, and the carrying direction of the paper is changed by an angle of approximately 90 degree. Then, the paper 5 is electrostatically adsorbed to the carrying belt 31 and the paper 5 is carried in the sub-scan direction by the revolution movement of the carrying belt 31.

Then, an ink drop is discharged onto the stopped paper 5 to record one line by driving the recording head 24 in response to an image signal while the carriage 23 is moved, and the paper 5 is intermittently carried and an image is formed on the paper 5 such that as the recording of the one line is completed, the paper 5 is carried by one line and the recording of next one line is performed. When a recording completion signal or a signal for indicating that the rear end of the paper 5 reached to a recording area is received, a recording operation is terminated. Subsequently, after standby processing is performed for the prevention of curl, the paper 5 is sent to the ejected paper tray 8 or the double face unit 10, as mentioned below.

Next, one example of ink (recording liquid, referred to as the "subject ink" below) used for this image formation apparatus is explained.

First, an example of pigment ink is explained. As a pigment, each kind of pigment used for ink jet is usable. Particularly, a type of pigment of which the surface is provided with a hydrophilic group, a type of pigment covered with polymer emulsion, and an insoluble pigment dispersed with a surface active agent or a water-soluble resin can be provided. Additionally, the polymer emulsion of ink is prepared in accordance with a preparation example described below.

Also, for a wetting agent used for the ink, at least one agent selected from glycerin, 1,3-butanediol, triethylene glycol, 1,6-hexanediol, propylene glycol, 1,5-pentanediol, diethylene glycol, dipropylene glycol, trimethylolpropane, and trimethylolethane is used.

Also, a polyol or glycol ether or anionic or nonionic surface active agent in which the number of carbon atoms are equal to or more than 8 and equal to or less than 11 is added.

As an example thereof, 2-ethyl-1,3-hexanediol, 2,2,4-trimethyl-1,3-pentanediol, and materials with structures of the following (I) through (VII) can be provided.

$$R_1—O—(CH_2CH_2O)_mCH_2COOM \quad (I)$$

(R1 is an alkyl group that may be branched, in which the number of carbons is 6-14. m is 3-12. M is an alkali metal ion, a quaternary ammoniumn ion, a quaternary phosphonium ion, or an alkanolamine.)

(II)

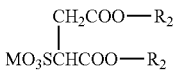

(R2 is a branched alkyl group, in which the number of carbons is 5-16. M is an alkali metal ion, a quaternary ammonium ion, a quaternary phosphonium ion, or an alkanolamine.)

(III)

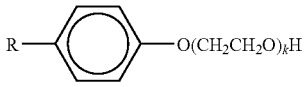

(R is a carbon chain that may be branched, in which the number of carbons is 6-14. k is 5-20.)

$$R—(OCH_2CH_2)_nOH \quad (IV)$$

(R is a carbon chain that may be branched, in which the number of carbons is 6-14. n is 5-20.)

$$H—(OCH_2CH_2)_m—(OCH(CH_3)CH_2)_n—R' \quad (V)$$

(R is a carbon chain, in which the number of carbons is 6-14. m, n satisfy m, n≦20.)

$$H—(OCH(CH_3)CH_2)_m—(OCH_2CH_2)_n—R' \quad (VI)$$

(R is a carbon chain, in which the number of carbons is 6-14. m, n satisfy m, n≦20.)

(VII)

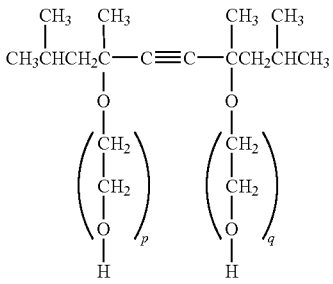

(p, q are 0-40.)

Due to the addition of them, the surface tension of ink decreases to 40 mN/m or less. In a printed picture image, particularly, the speed of penetration into a paper can be increased by making the surface tension be equal to or less than 40 mN/m. However, as its side effect, an air bubble becomes difficult to disappear. Also, the concentration of an image can be increased by making the viscosity of ink at 25° C. be equal to or greater than 5 mPa s.

Also, each kind of pH moderator, preservative, or mildew-proofing agent is added according to need. Also, it is useful to add alginic acid, etc., in order to increase the viscosity.

Next, a preparation example of a pigment ink is explained.

[Ink Preparation Example]

Ink was prepared by the following method.

(Reference 1) Preparation of a Polymer Fine Particle Dispersion Containing a Phthalocyanine Pigment A blue polymer fine particle dispersion was obtained by performing an additional test of adjustment example 3 disclosed in Japanese Laid-Open Patent Application 2001-139849, the entire contents of which are incorporated by reference herein. The average particle diameter (D50%) of the polymer fine particles which diameter was measured by Microtrack UPA was 93 nm.

(Reference 2) Preparation of a Polymer Fine Particle Dispersion Containing a Dimethylquinacridone Pigment A magenta polymer fine particle dispersion was obtained similarly to Reference 1 mentioned above, except that the phthalocyanine pigment of Reference 1 was changed to pigment red 122. The average particle diameter (D50%) of the polymer fine particles which diameter was measured by Microtrack UPA was 127 nm.

(Reference 3) Preparation of a Polymer Fine Particle Dispersion Containing a Monoazo Yellow Pigment A yellow polymer fine particle dispersion was obtained similarly to Reference 1 mentioned above, except that the phthalocyanine pigment of Reference 1 was changed to pigment yellow 74. The average particle diameter (D50%) of the polymer fine particles which diameter was measured by Microtrack UPA was 76 nm.

(Reference 4) Carbon Black Dispersion Liquid 1 Treated with a Diazo Compound 100 g of carbon black with a surface area of 230 $m^2/g$ and a DBP oil absorption of 70 ml/100 g and 34 g of p-amino-N-benzoic acid were mixed into and dispersed in 750 g of water, 6 g of nitric acid was dropped into the dispersion and stirring was made at 70° C. After 5 minutes, a solution obtained by dissolving 11 g of sodium nitrite in 50 g of water was added and stirring was further made for 1 hour. Obtained slurry was diluted to ten times and centrifuged so as to remove coarse particles, the pH was adjusted to a pH of 8-9 with diethanolamine, and desalting and concentration was made using a ultrafiltration membrane, so as to obtain a carbon black dispersion liquid with a pigment concentration of 15%. This liquid was filtered with a 0.5 μm polypropylene filter so as to obtain carbon black dispersion liquid 1. The average particle diameter (D50%) measured by Microtrack UPA was 99 nm.

Examples of pigment ink sets are shown below but the present invention is not limited to these examples. Herein, a quantity of each component (%) described in the examples is expressed in weight.

Example 1 of Pigment Ink Set

[Cyan Ink]

An ink composition was prepared in accordance with the following formulation and the pH thereof was made become 9 using a 10% aqueous solution of lithium hydroxide. Subsequently, filtration was performed using a membrane filter with an average pore size of 0.8 μm so as to obtain an ink composition.

Polymer fine particles containing the phthalocyanine pigment of Reference 1: 10.0 wt % (as a solid content)

1,3-butanediol: 25.0 wt %

Glycerol: 8.5 wt %

Surface active agent of $CH_3\ (CH_2)_{12}O(CH_2CH_2O)_3\ CH_2COOH$: 2.0 wt %

2-ethyl-1,3-hexanediol: 1.8 wt %

Proxel LV (preservative): 0.1 wt %

Anti-foaming agent: 0.05 wt %

Ion-exchanged water: Balance

[Magenta Ink]

An ink composition was prepared similarly to the cyan ink except that the following composition was used, the pH of which ink was made be 9 with sodium hydroxide.

Polymer fine particles containing the dimethylquinacridone pigment of Reference 2: 0.5 wt % (as a solid content)

1,3-butanediol: 22.0 wt %

Glycerol: 7.0 wt %

Polyoxyalkylene derivative Dispanol TOC: 2.0 wt %

2-ethyl-1,3-hexanediol: 2.0 wt %

Proxel LV (preservative): 0.05 wt %

Anti-foaming agent: 0.1 wt %

Ion-exchanged water: Balance

[Yellow Ink]

An ink composition was prepared similarly to the cyan ink except that the following composition was used, the pH of which ink was made be 9 with lithium hydroxide.

Polymer fine particles containing the monoazo yellow pigment of Reference 3: 10.0 wt % (as a solid content)

1,3-butanediol: 23.5 wt %

Glycerol: 7.5 wt %

Polyoxyalkylene derivative Dispanol TOC: 2.0 wt %

2-ethyl-1,3-hexanediol: 2.0 wt %

Proxel LV (preservative): 0.05 wt %

Anti-foaming agent KM72F: 0.1 wt %

Ion-exchanged water: Balance

[Black Ink]

An ink composition was prepared similarly to the cyan ink except that the following composition was used, the pH of which ink was made be 9 with sodium hydroxide.

Carbon black dispersion liquid 1 treated with the diazo compound of Reference 4: 10.0 wt % (as a solid content)

1,3-butanediol: 22.5 wt %

Glycerol: 7.5 wt %

N-methyl-2-pyrrolidone: 2.0 wt %

$CH_3\ (CH_2)_{12}O(CH_2CH_2O)_3CH_2COOH$: 2.0 wt %

2-ethyl-1,3-hexanediol: 2.0 wt %

Proxel LV (preservative): 0.2 wt %

Anti-foaming agent: 0.1 wt %

Ion-exchanged water: Balance

The physical properties of each ink in such a pigment ink set, example 1, were as shown in Table 1.

TABLE 1

| | Surface tension (mN/m) | Viscosity (mPa s) |
|---|---|---|
| Cyan | 32.1 | 8.3 |
| Magenta | 31.2 | 8.0 |
| Yellow | 31.6 | 7.9 |
| Black | 29.7 | 8.66 |

Example 2 of Pigment Ink Set

[Cyan Ink]

An ink composition was prepared in accordance with the following formulation and the pH thereof was made become 9 using a 10% aqueous solution of lithium hydroxide. Subsequently, filtration was performed using a membrane filter with an average pore size of 0.8 μm so as to obtain an ink composition.

Polymer fine particles containing the phthalocyanine pigment of Reference 1: 8.0 wt % (as a solid content)

Triethylene glycol: 22.5 wt %

Glycerol: 7.5 wt %

2-pyrrolidone: 5.0 wt %

$CH_3\ (CH_2)_{12}O(CH_2CH_2O)_3CH_2COOH$: 1.6 wt %

2-ethyl-1,3-hexanediol: 1.8 wt %

Proxel LV (preservative): 0.2 wt %

Anti-foaming agent: 0.1 wt %

Ion-exchanged water: Balance

[Magenta Ink]

An ink composition was prepared similarly to the cyan ink except that the following composition was used, the pH of which ink was made be 9 with sodium hydroxide.

Polymer fine particles containing the dimethylquinacridone pigment of Reference 2: 8.0 wt % (as a solid content)

Propylene glycol: 30.0 wt %

Glycerol: 10.0 wt %

N-methyl-2-pyrrolidone: 2.0 wt %

$CH_3(CH_2)_{12}O(CH_2CH_2O)_4CH_2COOH$: 1.7 wt %

2,2,4-trimethyl-1,3-pentanediol: 1.8 wt %

Proxel LV (preservative): 0.2 wt %

Anti-foaming agent: 0.1 wt %

Ion-exchanged water: Balance

[Yellow Ink]

An ink composition was prepared similarly to the cyan ink except that the following composition was used, the pH of which ink was made be 9 with lithium hydroxide.

Polymer fine particles containing the monoazo yellow pigment of Reference 3: 8.0 wt % (as a solid content)

1,3-butanediol: 22.5 wt %

Glycerol: 7.5 wt %

2-pyrrolidone: 5.0 wt %

$CH_3(CH_2)_{12}O(CH_2CH_2O)_6CH_2COOH$: 2.0 wt %

2,2,4-trimethyl-1,3-pentanediol: 1.8 wt %

Proxel LV (preservative): 0.2 wt %

Anti-foaming agent: 0.1 wt %

Ion-exchanged water: Balance

[Black Ink]

An ink composition was prepared similarly to the cyan ink except that the following composition was used, the pH of which ink was made be 9 with sodium hydroxide.

Polymer fine particles containing the carbon black of Reference 4: 8.0 wt % (as a solid content)

Dipropylene glycol: 20.0 wt %

Glycerol: 10.0 wt %

N-hydroxyethyl-2-pyrrolidone: 5.0 wt %

$CH_3(CH_2)_{12}O(CH_2CH_2O)_4CH_2COOH$: 1.7 wt %

2-ethyl-1,3-hexanediol: 1.5 wt %

Proxel LV (preservative): 0.2 wt %

Anti-foaming agent KS531 (Shin-Etsu Chemical Co., Ltd.): 0.1 wt %

Ion-exchanged water: Balance

The physical properties of each ink in this pigment ink set, example 2, were as shown in Table 2.

TABLE 2

| | Surface tension (mN/m) | Viscosity (mPa s) |
|---|---|---|
| Cyan | 32.1 | 6.10 |
| Magenta | 31.2 | 7.40 |
| Yellow | 31.5 | 6.10 |
| Black | 30.2 | 7.90 |

Example 3 of Pigment Ink Set

[Cyan Ink]

An ink composition was prepared in accordance with the following formulation and the pH thereof was adjusted using an organic pH moderator. Subsequently, filtration was performed using a membrane filter with an average pore size of 0.8 μm so as to obtain an ink composition.

Polymer fine particles containing the phthalocyanine pigment of Reference 1: 10.0 wt % (as a solid content)

Triethylene glycol: 25.0 wt %

Glycerol: 9.0 wt %

Surface active agent of $CH_3(CH_2)_{12}O(CH_2CH_2O)_3CH_2COOH$: 2.0 wt %

2,2,4-trimethyl-1,3-pentanediol: 2.0 wt %

Benzisothiazoline-based preservative: 0.2 wt %

Silicone anti-foaming agent SAG30 (Nippon Unicar Company Limited): 0.03 wt %

Ion-exchanged water: Balance

[Magenta Ink]

Preparation was made similarly to the cyan ink except that the following composition was used, and the pH was adjusted with sodium hydroxide.

Polymer fine particles containing the dimethylquinacridone pigment of Reference 2: 10.0 wt % (as a solid content)

Triethylene glycol: 22.0 wt %

Glycerol: 7.3 wt %

Nonionic surface active agent Softanol EP5035: 1.0 wt %

Alginic acid: 1.0 wt %

2-ethyl-1,3-hexanediol: 2.0 wt %

Benzisothiazoline-based preservative: 0.07 wt %

Silicone anti-foaming agent KS531 (Shin-Etsu Chemical Co., Ltd.): 0.02 wt %

Ion-exchanged water: Balance

[Yellow Ink]

Preparation was made similarly to the cyan ink except that the following composition was used, and the pH was adjusted with sodium hydroxide.

Polymer fine particles containing the monoazo yellow pigment of Reference 3: 11.0 wt % (as a solid content)

Triethylene glycol: 22.0 wt %

Glycerol: 7.3 wt %

Nonionic surface active agent Softanol EP5035: 1.0 wt %

Alginic acid: 1.0 wt %

2-ethyl-1,3-hexanediol: 1.8 wt %

Preservative: 0.05 wt %

Silicone-based anti-foaming agent: 0.1 wt %

Ion-exchanged water: Balance

[Black Ink]

An ink composition was prepared similarly to the cyan ink except that the following composition was used, and an organic pH moderator was used.

Carbon black dispersion liquid 1 treated with the diazo compound of Reference 4: 10.0 wt % (as a solid content)

Triethylene glycol: 22.0 wt %

Glycerol: 7.3 wt %

Surface active agent Softanol EP5035: 2 wt %

2-ethyl-1,3-hexanediol: 2.1 wt %

Preservative and mildewproofing agent: 0.2 wt %

Silicone anti-foaming agent KS531 (Shin-Etsu Chemical Co., Ltd.): 0.1 wt %

Ion-exchanged water: Balance

The physical properties of each ink in this pigment ink set, example 3, were as shown in Table 3.

TABLE 3

| | Surface tension (mN/m) | Viscosity (mPa s) |
|---|---|---|
| Cyan | 32.0 | 8.1 |
| Magenta | 30.1 | 7.7 |
| Yellow | 29.0 | 8.0 |
| Black | 31.0 | 7.7 |

A curl suppressing standby processing in the image formation apparatus configured as described above is explained with reference to FIGS. 6 and 7.

Figure 6:
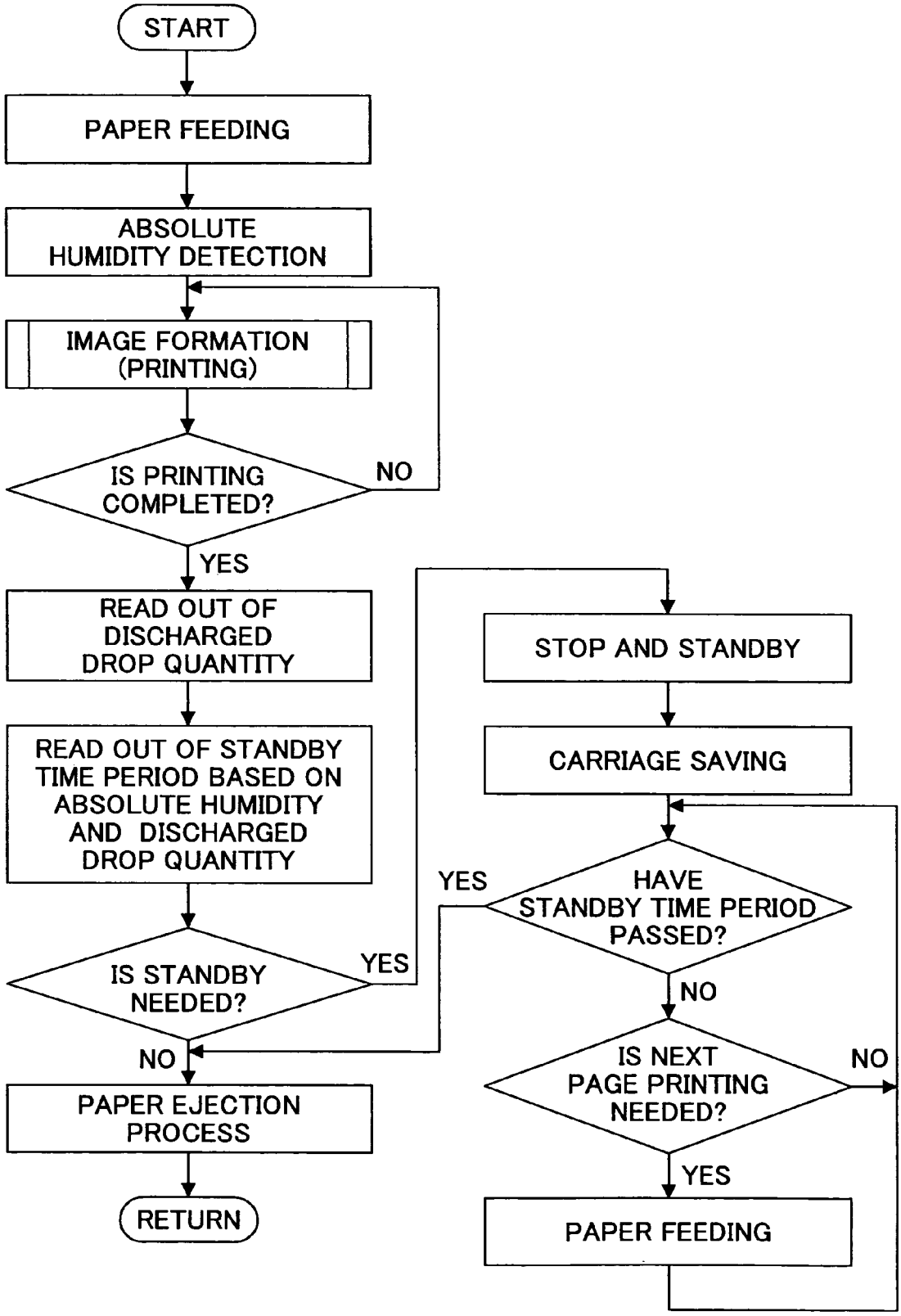
FIG. 6 is a flow chart provided for illustrating processes carried out by the control part.

As shown in FIG. 6, when printing starts, the papers 5 are separated one by one from the paper feeding cassette 41 by driving the paper feeding motor 45 and the paper is fed from the paper feed part 4 to the sub-scan carrying part 2. Herein, absolute humidity is detected, for example, by reading a detection signal from the temperature and humidity sensor 300 provided at a location of sensor S1 of FIG. 1.

Then, an image formation (printing or imaging) processing for forming a desired image on the paper 5 by the main scanning of the recording head 24 and the sub-scanning of the paper 5 is performed as mentioned above, and when the printing or imaging is completed, the amount (discharged drop quantity) of recording liquid discharged from the recording head 24 at the time of the printing or imaging. In regard to this discharged drop quantity, since the number of liquid drop(s) discharged from the recording head 24 is counted in order to calculate the amount of consumed ink in this image formation apparatus, this count value with respect to the number of the drop(s) is employed as the discharged drop quantity.

Subsequently, with respect to the paper 5 on which the image formation has been completed, whether standby until curl is difficult to occur (curl suppressing standby) is needed or not is judged based on the absolute humidity and the discharged drop quantity (or any one of them). In regard to the time period of the curl suppressing standby for the standby until the curl is difficult to occur on a paper, since the absolute humidity and the discharged drop quantity and the time period of the curl suppressing standby are previously tabulated and stored in the ROM 202, etc., whether the time period of curl suppressing standby is needed or not (whether the time period of curl suppressing standby is "0" or not) can be judged by referring to this table.

Then, if the time period of curl suppressing standby is needed, the paper ejecting motor 271 is stopped (if the paper ejecting motor 271 has not been driven at the time of image formation, the processing is to maintain the condition of stop.), the recording head 24 is made be under the condition of being saved to the side of the maintenance and recovery mechanism 121.

Figure 7:
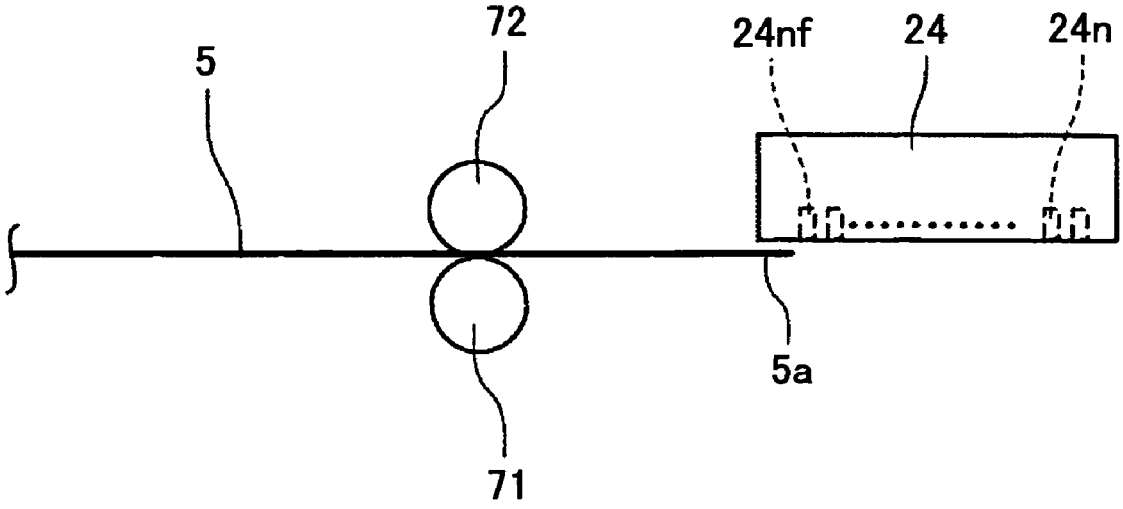
FIG. 7 is a diagram illustrating the relation between a paper on standby and a recording head.

Thereby, as shown in FIGS. 4 and 7, the paper 5 on which the image formation has been completed stops at the lower guiding plate 170A of the ejected paper carrying part 7, and the top and bottom of the paper are bound by the carrying rollers 71, 171-173 and spurs 72, 174-176 opposing thereto, so that curl becomes difficult to occur on the paper 5 (Curl tends to occur, but since the top and bottom are bound, consequently, the curl cannot be made.). That is, whereas only the stop of the paper on a condition such that the paper 5 is put on a paper ejection belt cannot suppress the curl of the paper as disclosed in Japanese Patent No. 3109529, since the top and bottom of at least one portion of the paper 5 are bound in this apparatus, the occurrence of curl can be suppressed. After standby until the curl of the recording medium is difficult to occur, a paper ejection operation is performed.

In this case, as shown in FIG. 7, when the rear end of the paper 5 is within a scanning area for the recording head 24 and the paper 5 is stopped on standby at a position that is more downstream than a nozzle 24*f* at the most downstream side along the paper carrying direction among nozzles 24*n* for discharging a liquid drop in the recording head 24, a carriage path length for making the paper be on standby is short.

Then, since the time period of curl suppressing standby has passed, that is, when the paper 5 has been on standby on the binding state until the curl is difficult to occur, respective rollers of the ejected paper carrying part 7 are rotationally driven by driving the paper ejecting motor 271, and in the case of one face printing, a process for ejecting the paper 5 onto the ejected paper tray 8 is directly performed. Additionally, in the case of double face printings, the paper 5 is sent to the double face unit 10. Also, in the case of double face printings, when paper ejection is performed without performing such a curl suppressing standby at the time of printing on a back face, the printing speed can be improved.

Thus, by including a part for performing a paper ejecting operation after standby until curl of a recording medium to be recorded becomes difficult to occur, on a condition of binding a top and bottom of at least one portion of the recording medium to be recorded on which image formation by a recording head has been completed, the occurrence of curl can be possibly suppressed so as to prevent the provision of a defective print and the occurrence of jam. Particularly, when a pigment-based ink with a viscosity equal to or greater than 5 mPa s at 25° C. is used as recording liquid, the application of the present invention is effective since curl easily occurs.

In this case, it becomes not necessary to perform standby where the curl suppressing standby is needed, by setting whether the curl suppressing standby is carried out or not and a standby time period when the curl suppressing standby is carried out, based on absolute humidity and discharged drop quantity (the amount of recording liquid adhering to a paper), so that the improvement of the overall printing speed is provided.

Additionally, when the curl suppressing standby is being performed, if next page printing is required, a next paper can be fed so as to perform printing or imaging to a position thereof at which the front end thereof does not interfere to a paper on standby. That is, paper feeding for a next paper can be allowed on the curl suppressing standby and the improvement of the printing speed of continuous printings can be provided by feeding and sending the paper 5 to an image formation area for the recording head 24 and making a driving part for sub-scanning (paper feeding motor 45, sub-scanning motor 131) and the paper ejecting motor 271 of the ejected paper carrying part 7 be driving parts different from each other.

Also, in the aforementioned example, when a paper is made be on standby for suppressing curl, the paper is on standby on the condition of stop, but a configuration such that the paper is carried and made be on standby while the top and bottom of the paper are bound by rollers (including spurs) in the double face unit 10 can be employed.

Further, the present invention is not limited to these embodiments or examples, but various variations and modifications may be made without departing from the scope of the present invention.

The present application is based on Japanese priority application No. 2004-237893 filed on Aug. 18, 2004, the entire contents of which are hereby incorporated by reference.

What is claimed is:

1. An image formation apparatus comprising:

a recording head configured to discharge recording liquid on a recording medium; and a recording medium ejection part comprising an upper guide plate, a lower guide plate, plural rollers and plural spurs such that both sides of at least a portion of said recording medium on which recording liquid has been discharged from said recording head are held substantially horizontally and straight for a time period while waiting until curl of said recording medium becomes difficult to occur and subsequently ejection of said recording medium is conducted, wherein the time period for holding said recording medium substantially horizontally and straight is variably set based on detected absolute humidity.

2. The image formation apparatus as claimed in claim 1, wherein both sides of at least a portion or said recording medium are nipped by said plural rollers and said plural spurs while a lower side of said recording medium is supported by said lower guide plate.

3. The image formation apparatus as claimed in claim 1, wherein said detected absolute humidity is based on ambient temperature and humidity around a recording medium feeding cassette to be loaded with said recording medium.

4. The image formation apparatus as claimed in claim 1, wherein said detected absolute humidity is based on ambient temperature and humidity around said recording medium.

5. The image formation apparatus as claimed in claim 1, wherein said recording medium is stopped until curl of said recording medium becomes difficult to occur.

6. The image formation apparatus as claimed in claim 5, wherein a rear end portion of said recording medium is located in an area scanned by said recording head until curl of said recording medium becomes difficult to occur.

7. The image formation apparatus as claimed in claim 6, wherein said recording head is withdrawn from a printing or imaging area.

8. The image formation apparatus as claimed in claim 1, wherein said recording medium is carded inside said apparatus while said recording medium is held substantially horizontally and straight.

9. The image formation apparatus as claimed in claim 1, wherein said recording medium is held based on quantity of liquid drop(s) applied to said recording medium.

10. The image formation apparatus as claimed in claim 1, wherein a driving part configured to deliver said recording medium to a position of image formation is different from a driving part configured to eject said recording medium.

11. The image formation apparatus as claimed in claim 1, wherein an image is formed using a pigment-used recording liquid with a viscosity equal to or greater than 5 mPas at 25° C.

* * * * *